US009401535B2

(12) United States Patent
Tabatabaei

(10) Patent No.: US 9,401,535 B2
(45) Date of Patent: Jul. 26, 2016

(54) MULTIPLE WAY WAVEGUIDE POWER MODULE

(71) Applicant: Teramics LLC, Mountain View, CA (US)

(72) Inventor: Seyed A. Tabatabaei, Mountain View, CA (US)

(73) Assignee: TERAMICS LLC, Mountain View, CA (US)

( * ) Notice: Subject to any disclaimer, the term of this patent is extended or adjusted under 35 U.S.C. 154(b) by 0 days.

(21) Appl. No.: 14/514,084

(22) Filed: Oct. 14, 2014

(65) Prior Publication Data

US 2015/0102871 A1 Apr. 16, 2015

Related U.S. Application Data

(60) Provisional application No. 61/890,069, filed on Oct. 11, 2013.

(51) Int. Cl.
*H01P 5/12* (2006.01)

(52) U.S. Cl.
CPC ..... *H01P 5/12* (2013.01)

(58) Field of Classification Search
CPC ..... H01P 5/12; H01P 5/082
USPC ..... 333/125–137
See application file for complete search history.

(56) References Cited

U.S. PATENT DOCUMENTS

| | | | | |
|---|---|---|---|---|
| 2,941,166 | A * | 6/1960 | Meyer | H01P 5/082 333/125 |
| 4,641,107 | A * | 2/1987 | Kalokitis | H03F 3/602 29/592.1 |
| 6,411,174 | B1 * | 6/2002 | Crouch | H01P 5/12 333/125 |
| 9,065,163 | B1 * | 6/2015 | Wu | H01P 3/12 |

* cited by examiner

*Primary Examiner* — Robert Pascal
*Assistant Examiner* — Kimberly Glenn
(74) *Attorney, Agent, or Firm* — Stevens Law Group; David R. Stevens

(57) ABSTRACT

Example power modules are described. In one implementation, a power module includes four RF signal ports that are electromagnetically coupled to a fifth RF signal port, which is substantially perpendicular to a geometric plane containing the four RF signal ports. Each of the four RF signal ports includes a waveguide and a reactive element extending into the waveguide. A termination port is electromagnetically coupled to the four RF signal ports and is substantially perpendicular to a geometric plane containing the four RF signal ports. The termination port is substantially coaxial with the fifth RF signal port.

19 Claims, 10 Drawing Sheets

MULTIPLE WAY WAVEGUIDE POWER MODULE

CROSS REFERENCE TO RELATED APPLICATIONS

This patent application claims priority to Provisional Application Ser. No. 61/890,069, entitled "Multiple Way Waveguide Power Divider/Combiner", filed Oct. 11, 2013, the disclosure of which is incorporated by reference herein in its entirety.

TECHNICAL FIELD

The present disclosure relates to the fields of waveguides, microwaves, millimeter wave radio frequency signals, and power distributers and power combiners for electromagnetic waves, such as radio frequency electromagnetic signals.

BACKGROUND

In the field of microwave signal propagation, there is a need to amplify the signal in order to increase the power of the signal. In order to do so, microwave monolithic integrated circuit (MMIC) power amplifiers are typically used. These amplifiers typically have a specific power gain that allows the input signal power to be amplified. There are certain applications, however, that require higher power handling capability than the typical MMIC power amplifier can handle. In this case, it is desirable to use a signal power divider/combiner device. A power divider takes in the signal to be amplified and then divides it into a number of output signals, such that the power in the input signal is equally divided among these output signals. Each of these output signals at reduced power can be equally amplified by an amplifier that can handle a relatively lower signal power, with each signal being routed to a separate amplifier. Finally, the outputs of these power amplifiers are collectively input to the RF signal combiner, wherein these amplified signals are combined to form the required output signal.

As an example, consider a signal having a power of 10 Watts, which needs to be amplified to 1000 Watts—a required amplifier power gain of 100. In this example, the current application is limited to using power amplifiers that can handle 300 Watts or less signal power. Without the use of a power divider/combiner device, it is not possible to get the output signal of the required power. In this case it is useful to divide the input signal using a power divider into, for example, four parts. Thus, the power divider outputs four signals, each 2.5 Watts in power. Each of these signals can be amplified by a gain of 100, to an output of 250 Watts, lower than the 300 Watt rating of the power amplifier. Finally, these four signals of 250 Watts each can be routed to the inputs of a power combiner to give the required output signal of 1000 Watts.

While the above example demonstrates the advantage of using waveguide power dividers and combiners, it must be noted that existing waveguide power combiners are ultimately power limited. Further, existing devices are also bandwidth limited—there is a limit to the range of frequencies that can be handled by the device. The present invention addresses the limitations of existing waveguide power dividers and combiners by designing a waveguide structure that allows for a greater power handling capability as well as an increase in bandwidth.

BRIEF DESCRIPTION OF THE DRAWINGS

Non-limiting and non-exhaustive embodiments of the present disclosure are described with reference to the following figures, wherein like reference numerals refer to like parts throughout the various figures unless otherwise specified.

DETAILED DESCRIPTION

Figure 1:
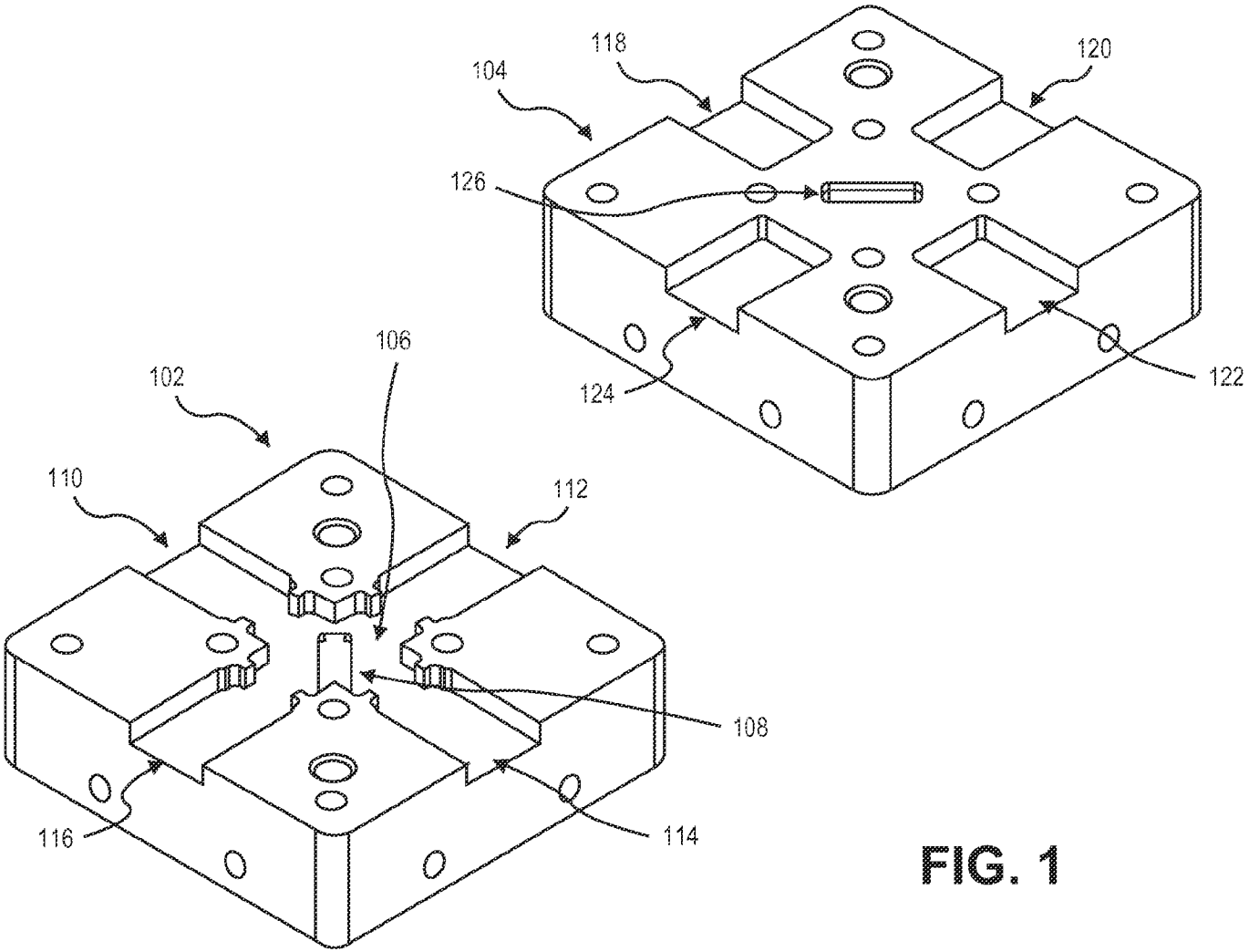
FIG. 1 illustrates an example power module having two components (a top portion and a bottom portion) that join together to form the power module.

The systems and methods described herein relate to a multiple way waveguide power module (referred to herein as a "power module") that functions as either a waveguide signal divider or a waveguide signal combiner for radio frequency (RF) electromagnetic signals. In one embodiment, the described system includes a power module that has four RF signal ports, with the four ports functioning as a waveguide for RF signals. There also exists a fifth RF signal port that is aligned substantially perpendicular to a plane containing the four RF signal ports. This fifth RF signal port functions as a waveguide for RF signals. There exists an electromagnetic coupling between the four RF signal ports and the fifth RF signal port in the sense that RF signal inputs through one or more of the four RF signal ports cause an RF signal output from the fifth RF signal port. Additionally, an RF signal input to the fifth RF signal port causes outputs from the four RF signal ports. Effective electromagnetic coupling is achieved by properly matching the waveguide design.

The power module is specifically designed to function as either an RF signal divider or an RF signal combiner. When the power module functions as an RF signal divider, a signal is input through the fifth RF signal port, and this signal gets divided equally into four RF signals, each of which is output via a unique RF signal port via the four RF signal ports via electromagnetic coupling. When the power module functions as an RF signal combiner, four RF signals are input to the power module, one signal into each of the four RF signal ports. In this case, the four RF input signals combine to form a signal that is output through the fifth RF signal port via electromagnetic coupling.

The power module also has a sixth RF signal port that functions as a termination port. The sixth RF signal port may also be referred to as a "termination port." The axis of the termination port is substantially perpendicular to the geometric plane containing the four RF signal ports and substantially coaxial with the fifth RF signal port. The termination port is also electromagnetically coupled with the four RF signal ports. The function of this sixth RF signal port is to absorb undesirable signal reflections that degrade the performance of the power module in the event of the failure of one or more amplifiers coupled to one or more of the four RF signal ports. In this sense, the power module possesses the property of graceful degradation. Graceful degradation occurs when an electronic device or power module coupled to one or more of the four RF signal ports does not cause complete failure in the power module. Instead, the power module continues operating, possibly at a lower level of performance. This feature is particularly useful in situations where the power module is difficult to access.

In the following description, reference is made to the accompanying drawings that form a part thereof, and in which is shown by way of illustration specific exemplary embodiments in which the disclosure may be practiced. These embodiments are described in sufficient detail to enable those skilled in the art to practice the concepts disclosed herein, and it is to be understood that modifications to the various disclosed embodiments may be made, and other embodiments may be utilized, without departing from the scope of the present disclosure. The following detailed description is, therefore, not to be taken in a limiting sense.

Reference throughout this specification to "one embodiment," "an embodiment," "one example," or "an example" means that a particular feature, structure, or characteristic described in connection with the embodiment or example is included in at least one embodiment of the present disclosure. Thus, appearances of the phrases "in one embodiment," "in an embodiment," "one example," or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it should be appreciated that the figures provided herewith are for explanation purposes to persons ordinarily skilled in the art and that the drawings are not necessarily drawn to scale.

The systems and methods described herein disclose a power module that functions as either a signal combiner or a signal divider for radio frequency electromagnetic signals. In one embodiment, the power module consists of four RF signal ports, a fifth RF signal port that is substantially perpendicular to a plane containing the four RF signal ports, and a sixth RF signal port that is also substantially perpendicular to a plane containing the four RF signal ports and substantially coaxial with the fifth RF signal port. The fifth RF signal port is electromagnetically coupled with the four RF signal ports, wherein the fifth RF signal port functions as either an input port or an output port, with the four RF signal ports collectively functioning as output ports or input ports respectively, and the power module functioning as an RF signal divider or an RF signal combiner respectively. The sixth RF signal port is configured as a termination port, serving to absorb undesirable reflections that serve to degrade the performance of the power module.

FIG. 1 illustrates an example of two components that join together to form the power module. The two components consist of a top portion 102 and a bottom portion 104. The top portion 102 is configured to include a central cavity 106 and also four channels 110, 112, 114 and 116 that are part of the four RF signal ports. The top portion 102 is also configured to include the fifth RF signal port 108. The bottom portion 104 is configured to include channels 118, 120, 122 and 124 that are part of the four RF signal ports. The bottom portion 104 is also configured to include a sixth RF signal port 126 (also referred to as a "termination port").

In one embodiment, a power module that functions as a signal combiner with four RF signal ports receiving individual signals at a frequency of 20 GHz will be substantially square in shape as viewed from the top, with the dimension of one edge being approximately 2 inches. Some embodiments of the disclosed power module may be constructed from materials such as aluminum, brass and copper. Other embodiments of the disclosed power module could be constructed from plastic, with metal-plated walls. Alternate embodiments of the power module may be of any shape and any dimension.

Figure 2:
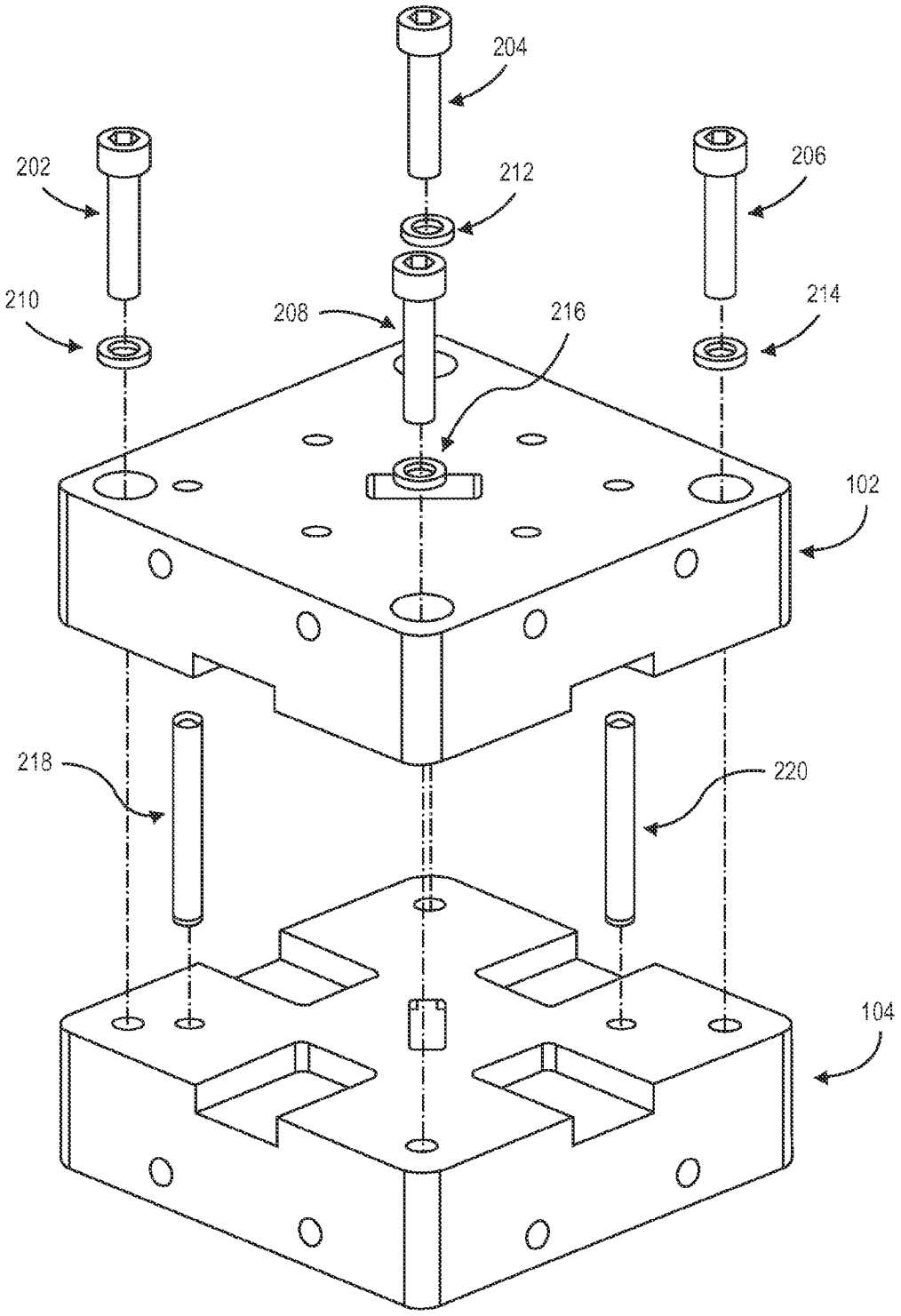
FIG. 2 illustrates an example of the two components are joined together to form the power module.

FIG. 2 illustrates an example of the two components 102 and 104 joined together to form the power module. The drawing shows how the channels 110, 112, 114 and 116 that form a part of each of the four RF signal ports on the top portion 102 align with channels 118, 120, 122 and 124 that form a part of each of the four RF signal ports on the bottom portion 104 (not necessarily in the same order) to form four waveguides that transmit the input or output signals. In this arrangement, the fifth RF signal port waveguide structure 108 on the top portion 102 is substantially orthogonal to the sixth RF signal port 126 waveguide structure on the bottom portion 104. In some embodiments, components 102 and 104 are joined together using bolts 202, 204, 206 and 208 and washers 210, 212, 214 and 216, with dowel pins 218 and 220 used for aligning the two components 102 and 104. In some implementations, bolts 202, 204, 206 and 208 may thread into component 104. In other implementations, bolts 202, 204, 206 and 208 attach to component 104 using any mechanism capable of securing bolts 202, 204, 206 and 208 to component 104.

In some embodiments, the top portion 102 and the bottom portion 104 of the power module can be joined together using bolts (as mentioned above) or clips. In other embodiments, the top portion 102 and the bottom portion 104 may be joined together by using processes such as brazing, dip-brazing and electro-forming. The sixth RF signal port 126 is terminated, and serves to absorb undesired reflections that can degrade the performance of the power module.

The sixth RF port 126 is designed to absorb all the energy entering this port due to component mismatch and/or due to the failure of any electronic components coupled to the four RF signal ports formed by the alignment of the channels 110, 112, 114 and 116 on the top portion 102 and channels 118, 120, 122 and 124 on the bottom portion 104 (not necessarily in the same order). In some embodiments, none of the signal energy entering the sixth RF signal port 126 is reflected back out of the port into the central cavity 106, into the fifth RF signal port 108, or into the four RF signal ports formed by the alignment of the channels 110, 112, 114 and 116 on the top portion 102 and channels 118, 120, 122 and 124 on the bottom portion 104 (not necessarily in the same order).

In some embodiments, the fifth RF signal port 108 is located on the axis of the cross formed by the four waveguides formed by the alignment of channels 110, 112, 114 and 116, and channels 118, 120, 122 and 124, and is rotated 45 degrees so that it electromagnetically couples substantially equally to the four arms. The sixth RF signal port is on the same axis as the fifth RF signal port but on the opposite side of the junction and is rotated by 90 degrees with respect to the fifth RF signal port, and hence is electromagnetically uncoupled to it. The power module may include a capacitive iris each for the fifth RF signal port and the sixth RF signal port. For each of the four other ports, a reactive element may be used.

Reactive elements include inductive elements and capacitive elements, which are electrically equivalent to inductors and capacitors that function as reactive elements in standard electronic circuits. Different series and parallel combinations of inductive and capacitive elements may be used to construct the reactive elements. In the following description, the term reactive element includes any series and/or parallel combinations of inductive and/or capacitive elements.

For waveguides, some reactive elements are implemented as physical extensions into the waveguide, and can take the form of inductive irises and capacitive irises, where an iris is equivalent to the presence of a metal plate or obstruction that extends into the waveguide. Reactive elements work by altering the electromagnetic field of the signal that travels through the waveguide. Just like the standard inductor and capacitor elements in circuits, the influence of the inductive and capacitive irises on the signal traveling through the waveguide is dependent on frequency. Incorporating the inductive and capacitive irises as physical extensions into the waveguide can be achieved by forming the waveguide during the manufacturing process such that its physical structure incorporates the required reactive elements.

Alternatively, reactive elements can be realized by physically inserting posts and/or screws (or similar objects) made of conductive material into the waveguide. In the event that these posts and/or screws are used in the central cavity of the power module, the effective volume of the central cavity is reduced, thereby reducing the amount of power that the power module can handle. The power module disclosed herein does not use posts or screws in order to implement the reactive elements, nor is there any extension by the inductive and capacitive irises into the central cavity. Thus, the described systems and methods do not reduce the size of the central capacity. This configuration allows the power module to have a higher power handling capability, which is one of the advantages of the disclosed power module.

In some embodiments, the waveguides in the power module may include reactive elements that are a combination of inductive elements and capacitive elements extending into one or more of the waveguides. These reactive elements could be some combination of inductive elements and capacitive elements (including inductive and capacitive irises). By configuring the reactive elements as extending into one or more of the waveguides, the power module does not need to rely on physical elements such as screws positioned in the central cavity. This increases the effective height of the central cavity which allows the power module to handle higher power levels.

Figure 3:
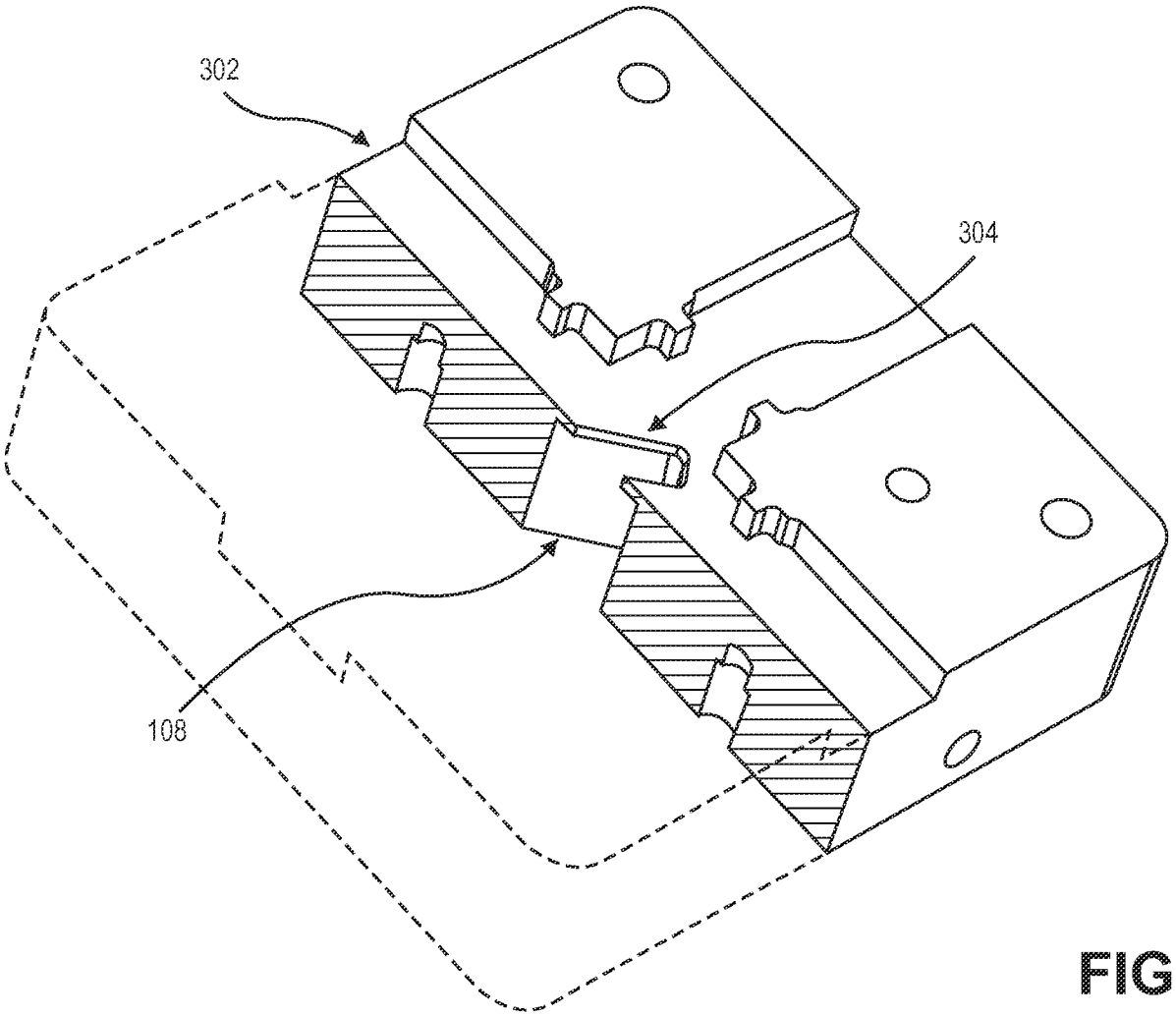
FIG. 3 is a cutaway diagram showing an example cross-section and the internal structure of one view of the top portion of the power module.

FIG. 3 illustrates an example cutaway 302 revealing a cross-section and internal structure of one view of the top portion of the power module 102. Also shown in FIG. 3 are the fifth RF signal port 108 and the capacitive element 304 that extends into the waveguide structure of the fifth RF signal port 108. The figure also shows that the capacitive element 304 is farther from the top of the top section 302 and closer to the bottom.

Figure 4:
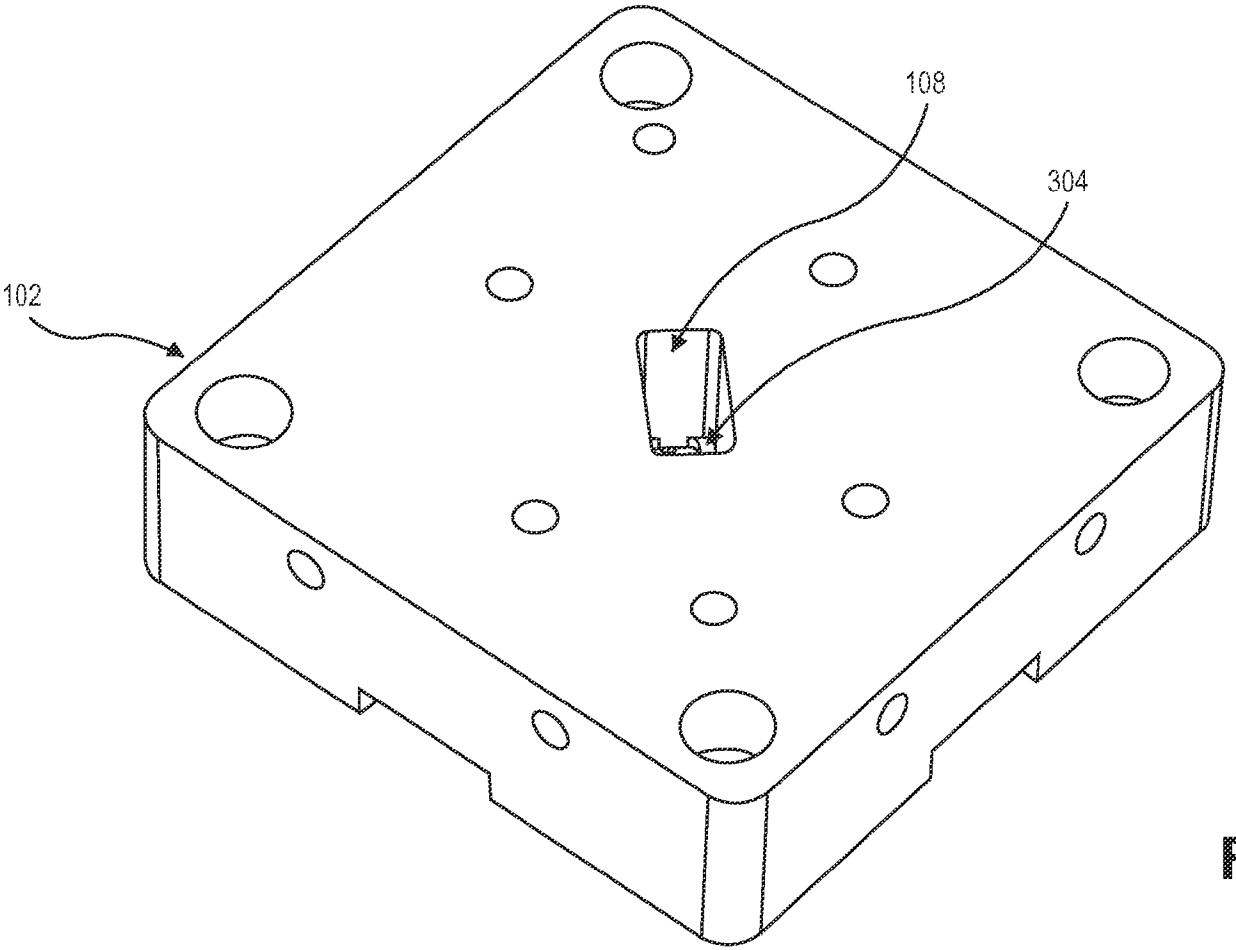
FIG. 4 illustrates an example top view of the top portion of the power module.

FIG. 4 illustrates an example of the top portion of the power module 102. Also shown in this drawing are the fifth RF signal port 108 and the capacitive element 304 that extends into the waveguide structure of the fifth RF signal port 108. The figure also shows that the capacitive element 304 is farther from the top of the top section 102 and closer to the bottom.

Figure 5:
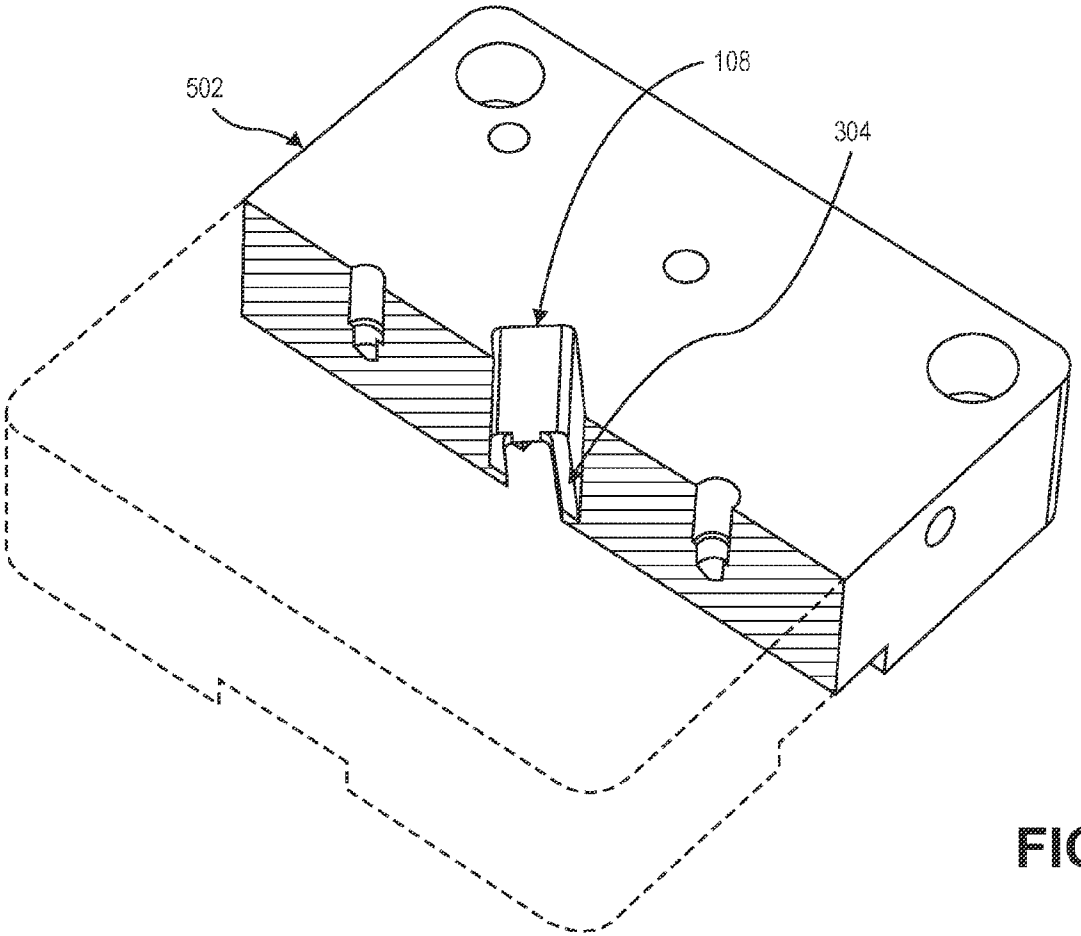
FIG. 5 is a cutaway diagram showing an example cross-section and the internal structure of the top portion of the power module.

FIG. 5 illustrates an example cutaway 502 revealing a cross-section and internal structure of a view showing the top portion of the power module 102. Also shown in this drawing are the fifth RF signal port 108 and the capacitive element 304 that extends into the waveguide structure of the fifth RF signal port 108. The figure also shows that the capacitive element 304 is farther from the top of the top section 502 and closer to the bottom.

Figure 6:
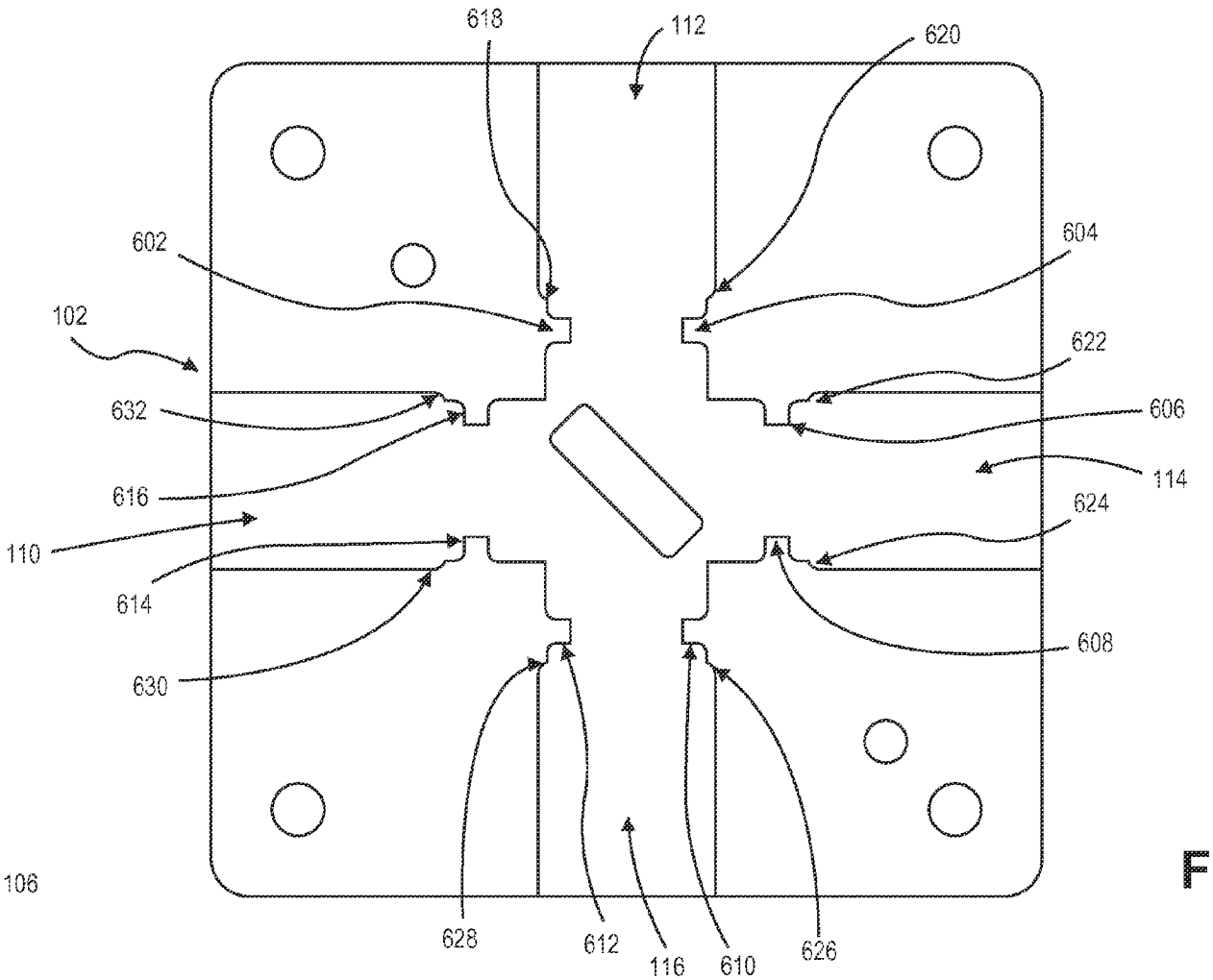
FIG. 6 illustrates an example bottom view of the top portion of the power module.

FIG. 6 illustrates an example bottom view of the top portion of the power module 102. The drawing also shows the inductive elements 602, 604, 606, 608, 610, 612, 614 and 616, and the capacitive elements 618, 620, 622, 624, 626, 628, 630 and 632 that extend out into the RF signal port waveguide portions 110, 112, 114 and 116. The inductive elements 602, 604, 606, 608, 610, 612, 614 and 616 are configured as physical extensions into the channels 112, 114, 116 and 118. The capacitive elements 618, 620, 622, 624, 626, 628, 630 and 632 are positioned adjacent to the inductive elements 602, 604, 606, 608, 610, 612, 614 and 616 respectively. It is seen that the inductive elements 602, 604, 606, 608, 610, 612, 614 and 616 and the capacitive elements 618, 620, 622, 624, 626, 628, 630 and 632 do not extend into the central cavity 106. This allows the power module to operate with a larger central cavity than would have been possible if the inductive elements and capacitive elements extended into the central cavity 106. The larger size of the central cavity 106 allows the power module to have a higher power handling capability compared to power modules in which the reactive elements extend into the central cavity. The drawing also shows that this embodiment places the capacitive elements before the inductive elements for a signal traveling along any of the four RF signal ports 112, 114, 116, or 118 in a direction from the edge of the top portion of the power module 102 towards the central cavity 106.

The dimensions of the inductive elements 602, 604, 606, 608, 610, 612, 614 and 616 and capacitive elements 618, 620, 622, 624, 626, 628, 630 and 632 are configured depending on design parameters which, in turn, are based on the desired frequency response for the power module.

Figure 7:
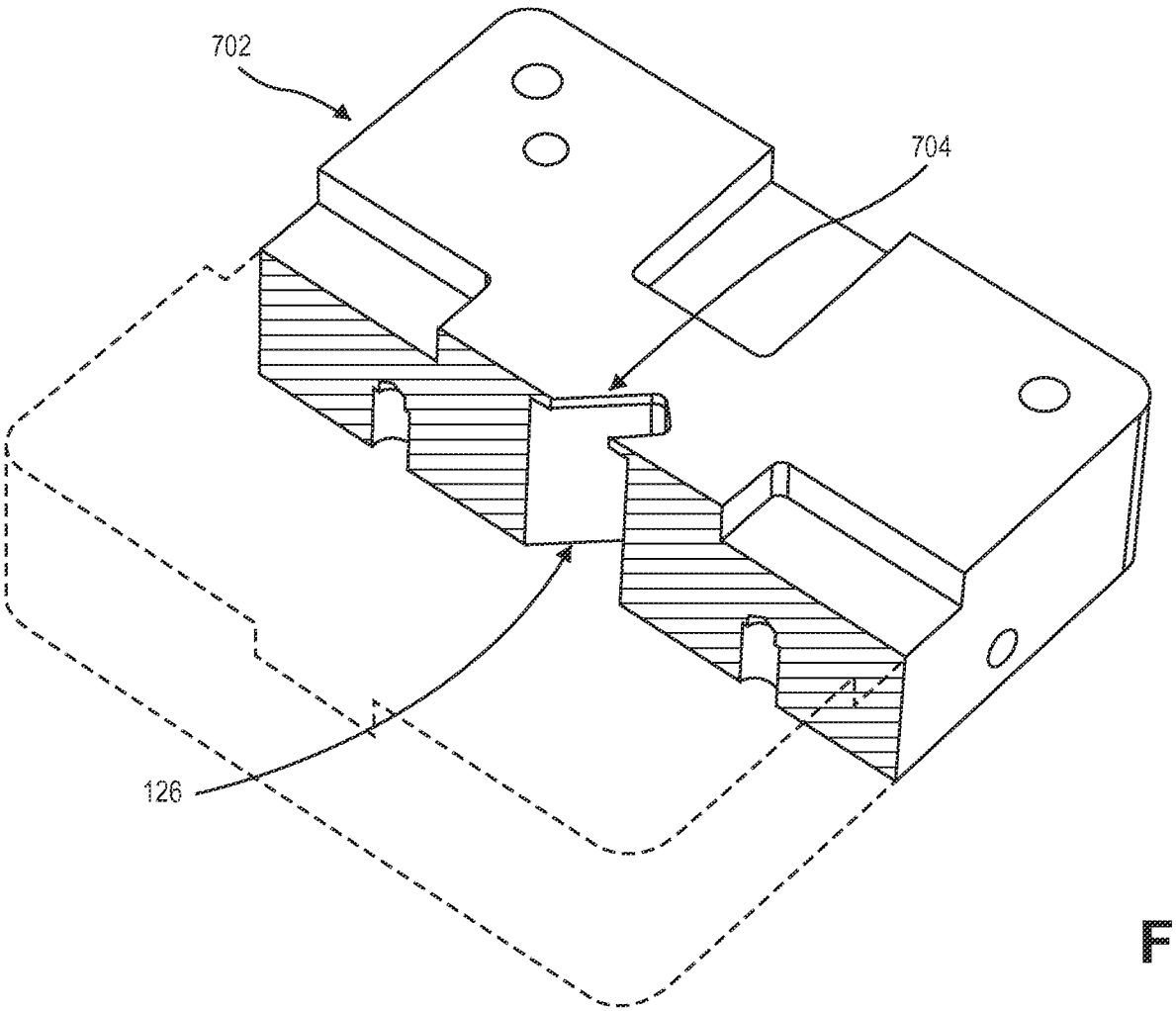
FIG. 7 is a cutaway diagram showing an example cross-section and the internal structure of one view of the bottom portion of the power module.

FIG. 7 illustrates an example cutaway 702 revealing a cross-section and the internal structure of one view of the bottom portion of the power module 104. Also shown in this drawing are the sixth RF signal port 126 and the capacitive element 704 that extends into the waveguide structure of the sixth RF signal port 126. The figure also shows that the capacitive element 704 is farther from the bottom of the bottom section 702 and closer to the top.

Figure 8:
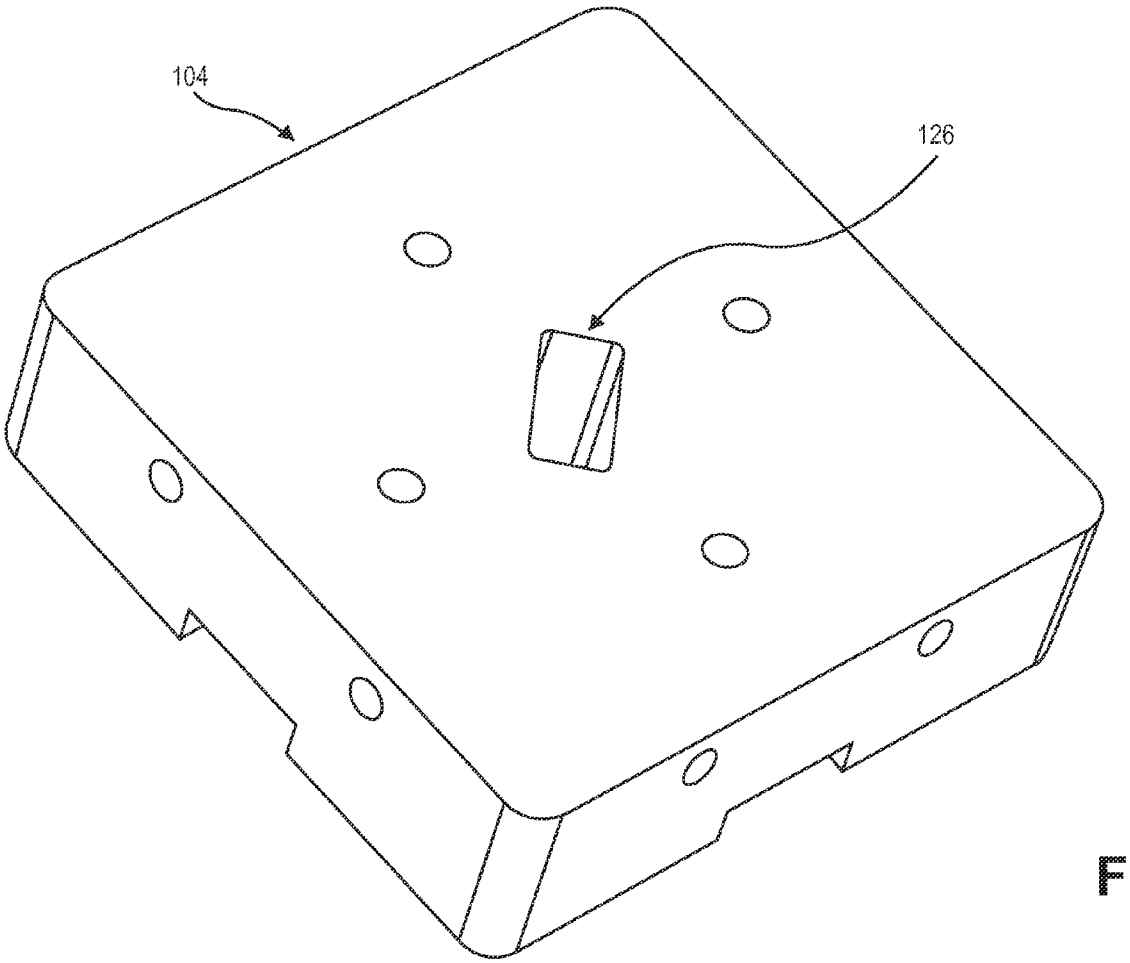
FIG. 8 illustrates an example of the bottom of the bottom portion of the power module.

FIG. 8 illustrates an example of the bottom of the bottom portion of the power module 104. Also shown in this drawing is the sixth RF signal port 126.

Figure 9:
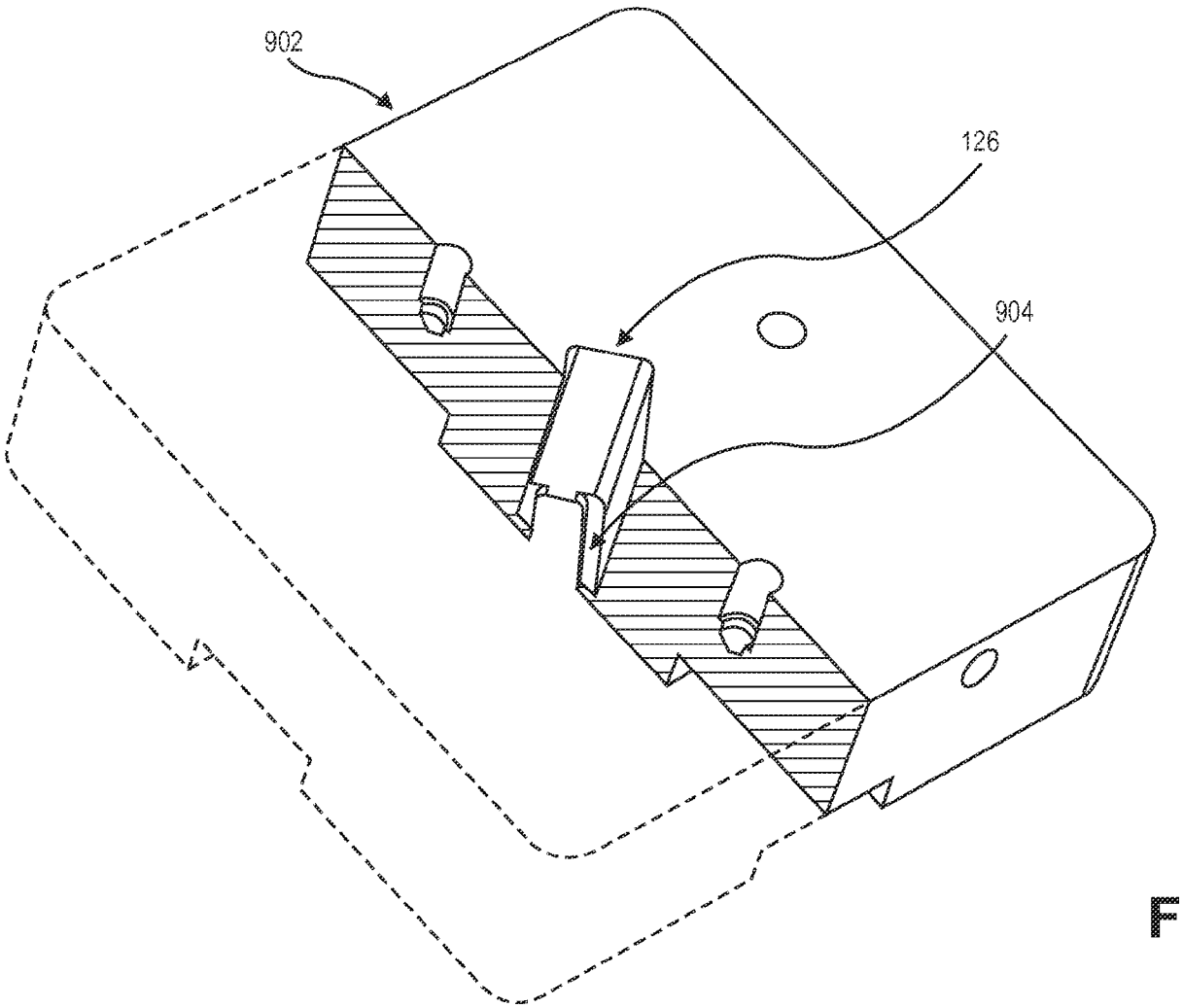
FIG. 9 is a cutaway diagram showing an example cross-section and the internal structure of the bottom portion of the power module.

FIG. 9 illustrates an example cutaway 902 revealing a cross-section and internal structure of a view showing the bottom portion of the power module 104. Also shown in this drawing are the sixth RF signal port 126 and the capacitive element 904 that extends into the waveguide structure of the sixth RF signal port 126. The figure also shows that the capacitive element 904 is farther from the bottom of the bottom section 902 and closer to the top.

Figure 10:
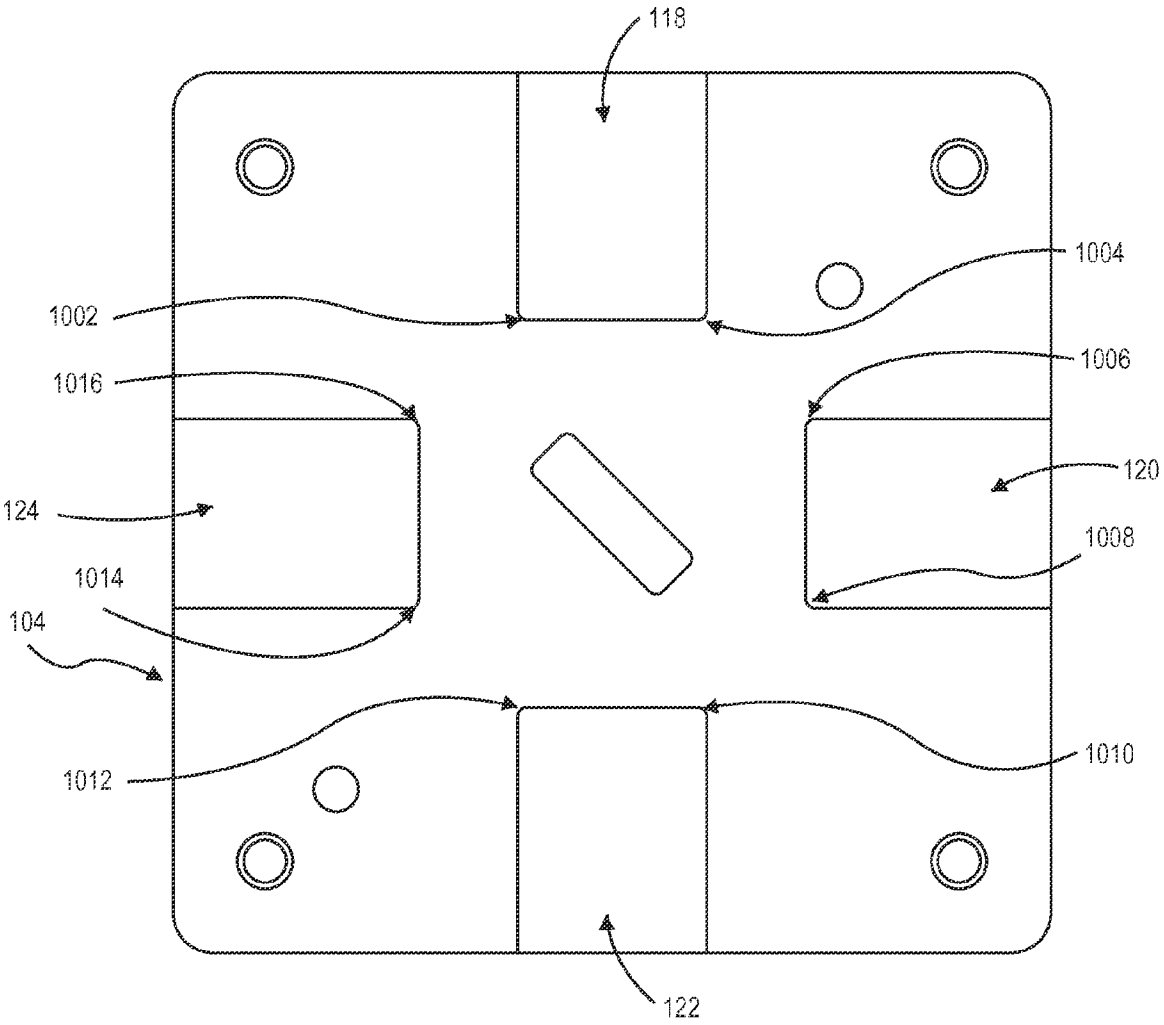
FIG. 10 illustrates an example top view of the bottom portion of the power module.

FIG. 10 is a drawing that shows the top view of the bottom portion of the power module 104. The drawing also shows the capacitive elements 1002, 1004, 1006, 1008, 1010, 1012, 1014 and 1016 that extend out into the RF signal port waveguide portions 118, 120, 122 and 124. The top portion 102 and bottom portion 104 of the power module are designed such that the capacitive elements 618, 620, 622, 624, 626, 628, 630 and 632 in the top portion 102 and the capacitive elements 1002, 1004, 1006, 1008, 1010, 1012, 1014 and 1016 in the bottom portion are substantially aligned with each other.

The disclosed power module can operate either as a power divider or as a power combiner. When the device operates as a power divider, the fifth RF port 108 functions as an input port. The input signal travels down the waveguide constituting the fifth RF signal port 108 and enters the central cavity 106. In the central cavity, the signal divides substantially equally into four parts, with each part traveling down the waveguide associated with each of the four RF signal ports that are composed of the alignment of the channels 110, 112, 114 and 116 on the top portion 102 and the channels 118, 120, 122 and 124 on the bottom portion 104. The power of each of these four signals that travels down the four waveguides is substantially one-fourth the power of the input signal. In this way, the power module functions as a power divider.

Each of the output signals at reduced power can be passed through a power amplifier, and the routed to a power module configured as a power combiner. When the power module is configured as a power combiner, four RF signals enter the power module, with one signal entering through each of the four RF signal ports that are composed of the alignment of the channels 110, 112, 114 and 116 on the top portion 102 and the channels 118, 120, 122 and 124 on the bottom portion 104. Upon entering the central cavity 106, the four signals combine and travel down the waveguide associated with the fifth RF signal port 108 that functions as an output port. The power output from the fifth RF signal port is the substantially the sum of the powers of the individual four signals entering the four RF signal ports. In this way, the power module functions as a power combiner.

The combination of a power divider coupled to amplifiers via the four RF signal ports which are then coupled to the four RF signal ports of a power combiner thus forms a system that can be used to amplify signal power without having to use power amplifiers with excessively high gain. In some embodiments, multiple such structures can be stacked vertically, one above the other, thus increasing the number of input/output RF signal ports. For example, multiple copies of the embodiment described above with four RF signal ports can be stacked vertically, one above the other. If 16 copies are stacked in such a manner, this results in a composite device with 64 RF signal ports that can function as either input or output ports depending on whether the device is used as an RF power combiner or an RF power divider respectively. This further serves to improve power handling capacity while enabling the device to handle a larger number of input or output signals.

The function of the sixth RF signal port 126 is to absorb undesirable reflections associated with mismatched components or the failure of any electronic components coupled to the four output RF signal ports. This aspect prevents the total failure of the operation of the power module in the event of a failure in the electronics coupled to one more of the four RF signal ports. Instead, the power module continues to operate at a lower performance level, thereby degrading gracefully rather than completely shutting down.

The capacitive element 304 associated with the fifth RF signal port 108, the inductive elements 602, 604, 606, 608, 610, 612, 614 and 616, the capacitive elements formed by the alignment of the capacitive elements 618, 620, 622, 624, 626, 628, 630 and 632 and 1002, 1004, 1006, 1008, 1010, 1012, 1014 and 1016, and the capacitive element 704 associated with the sixth RF signal port 126 serve to determine the frequency response of the power module, which is the allowable range of signal frequencies that the power module can allow to pass through it.

The structure of the reactive elements used in this power module can be altered at design time. This allows the designer to change the bandwidth of the power module. With proper design, the bandwidth of the power module can be increased, which is another advantage of the described systems and methods. The design process for the power module may include defining the power module as a fully parameterized three-dimensional (3D) model in an electromagnetic simulation, where the 3D model includes the reactive elements. Through proper optimization, the proper parameters, and hence the suitable dimensions of the reactive elements, can be determined.

Although the present disclosure is described in terms of certain preferred embodiments, other embodiments will be apparent to those of ordinary skill in the art, given the benefit of this disclosure, including embodiments that do not provide all of the benefits and features set forth herein, which are also within the scope of this disclosure. It is to be understood that other embodiments may be utilized, without departing from the scope of the present disclosure.

The invention claimed is:

1. An apparatus comprising:

four RF signal ports, wherein each of the four RF signal ports includes a waveguide and a reactive element extending into the waveguide;

a fifth RF signal port electromagnetically coupled to the four RF signal ports, wherein the axis of the fifth RF signal port is substantially perpendicular to a geometric plane containing the four RF signal ports; and a termination port electromagnetically coupled to the four RF signal ports, wherein the axis of the termination port is substantially perpendicular to the geometric plane containing the four RF signal ports and substantially coaxial with the fifth RF signal port.

2. An apparatus according to claim 1, wherein the four RF signal ports are collinear with a center of a cavity in the middle of the apparatus.

3. An apparatus according to claim 1, wherein the first four RF signal ports are symmetrically oriented around a cavity in the middle of the apparatus.

4. An apparatus according to claim 1, wherein the reactive element extending into the waveguide is an inductive element.

5. An apparatus according to claim 1, wherein the reactive element extending into the waveguide is a capacitive element.

6. An apparatus according to claim 1 that includes a capacitive iris for the fifth RF signal port and the termination port.

7. An apparatus according to claim 1 wherein the fifth RF signal port is axially rotated by 45 degrees with respect to the four RF signal ports and the termination port is axially rotated by 90 degrees with respect to the fifth RF signal port.

8. An apparatus according to claim 1 wherein each of the four RF signal ports can function together as either input or output ports, in which case the fifth RF signal port functions as an output or an input port respectively, wherein the apparatus functions as an RF signal combiner or an RF signal divider respectively.

9. An apparatus comprising:

a plurality of RF signal ports, wherein each of the plurality of RF signal ports includes a waveguide and a reactive element extending into the waveguide;

an additional RF signal port electrically coupled to the plurality of RF signal ports, wherein the axis of the additional RF signal port is substantially perpendicular to a geometric plane containing the plurality of RF signal ports; and a termination port electrically coupled to the plurality of RF signal ports, wherein the axis of the termination port is substantially perpendicular to the geometric plane containing the plurality of RF signal ports, and substantially coaxial with the additional RF signal port.

10. An apparatus according to claim 9, wherein the function of the termination port is to absorb undesirable RF signal reflections that serve to degrade the performance of the power module in the event of the failure of one or more amplifiers coupled to the RF signal ports, thereby reducing the adverse effect of such reflections.

11. An apparatus according to claim 9, wherein the RF signal ports are collinear with a center of a cavity in the middle of the apparatus.

12. An apparatus according to claim 9, wherein the RF signal ports are symmetrically oriented around a cavity in the middle of the apparatus.

13. An apparatus according to claim 9, wherein the reactive element extending into the waveguide includes one of an inductive element or a capacitive element.

14. An apparatus according to claim 9 that includes a capacitive iris for the additional RF signal port and the termination port.

15. An apparatus according to claim 9 wherein the additional RF signal port is axially rotated by 45 degrees with respect to the RF signal ports and the termination port is axially rotated by 90 degrees with respect to the additional RF signal port.

16. An apparatus according to claim 9 wherein the failure of electronics coupled to one or more of the RF signal ports does not result in the failure of the remaining RF signal ports.

17. An apparatus according to claim 9 wherein each of the RF signal ports can function together as either input or output ports, in which case the additional RF signal port functions as an output or an input port respectively, wherein the apparatus functions as an RF signal combiner or an RF signal divider respectively.

18. An apparatus according to claim 9, wherein multiple structures, each comprising a plurality of RF signal ports, an additional RF signal port and a termination port, are stacked vertically in order to increase the effective number of available RF signal ports.

19. An apparatus comprising:

a plurality of RF signal ports, wherein each of the RF signal ports includes a waveguide and a reactive element extending into the waveguide;

an additional RF signal port electromagnetically coupled to the plurality of RF signal ports, wherein the axis of the additional RF signal port is substantially perpendicular to a geometric plane containing the plurality of RF signal ports; and a termination port, separate from the plurality of RF signal ports and the additional RF signal port, electromagnetically coupled to the plurality of RF signal ports, wherein the axis of the termination port is substantially perpendicular to the geometric plane containing the plurality of RF signal ports and substantially coaxial with the additional RF signal port.

* * * * *